US006007467A

United States Patent [19]

Becker et al.

[11] Patent Number: 6,007,467

[45] Date of Patent: Dec. 28, 1999

[54] METHOD FOR FORMING AN INSULATING INNER CONTAINER

[75] Inventors: John W. Becker, Long Beach; Tomas Toro, Harbor City, both of Calif.

[73] Assignee: Eastern Seaboard Packaging, Inc., Newark, Del.

[21] Appl. No.: 09/074,671

[22] Filed: May 8, 1998

Related U.S. Application Data

[62] Division of application No. 08/681,996, Jul. 30, 1996, Pat. No. 5,820,268.

[51] Int. Cl.[6] ..... B31B 7/00

[52] U.S. Cl. ..... 493/93; 493/99; 493/906; 493/907

[58] Field of Search ..... 493/93, 95, 99, 493/907, 903, 906; 53/175

[56] References Cited

U.S. PATENT DOCUMENTS

| | | | |
|---|---|---|---|
| 875,224 | 12/1907 | Underwood | 383/99 |
| 1,753,813 | 4/1930 | Washburn | 383/99 |
| 1,768,989 | 7/1930 | Laacke | 383/99 |
| 1,951,604 | 3/1934 | Friedlander | 383/99 |
| 2,132,956 | 10/1938 | Kieckhefer | 493/93 |
| 2,272,938 | 2/1942 | Ferrante | 383/99 |
| 2,431,030 | 11/1947 | Edwards | 383/99 |
| 2,528,715 | 11/1950 | Wagner | 62/91.5 |
| 4,674,127 | 6/1987 | Yamada et al. . | |
| 4,704,731 | 11/1987 | Katase et al. . | |
| 4,889,252 | 12/1989 | Rockom et al. . | |
| 4,929,094 | 5/1990 | Becker | 383/99 |
| 5,009,326 | 4/1991 | Reaves et al. . | |
| 5,050,766 | 9/1991 | Groh . | |
| 5,071,025 | 12/1991 | Boots . | |
| 5,080,253 | 1/1992 | Zieke . | |
| 5,100,016 | 3/1992 | Wischusen, III . | |
| 5,110,005 | 5/1992 | Schilling . | |
| 5,111,957 | 5/1992 | Hollander et al. . | |
| 5,154,309 | 10/1992 | Wischusen, III et al. . | |
| 5,201,868 | 4/1993 | Johnson . | |
| 5,314,087 | 5/1994 | Shea . | |
| 5,427,267 | 6/1995 | Willman . | |
| 5,429,264 | 7/1995 | Hollander et al. . | |
| 5,439,133 | 8/1995 | Stone . | |
| 5,595,320 | 1/1997 | Aghassipour | 383/99 |

FOREIGN PATENT DOCUMENTS

| | | | |
|---|---|---|---|
| 745619 | 3/1944 | Germany | 53/175 |

*Primary Examiner*—Peter Vo
*Assistant Examiner*—Matthew Luby
*Attorney, Agent, or Firm*—Liniak, Berenato, Longacre & White, LLC

[57] ABSTRACT

An improved method for packaging perishable goods comprises an inner insulating container that is quickly and easily formed from a flat sheet of metalized bubble pack material to a finished state that very closely approximates the size and dimensions of the carton. The constructed inner container can be quickly collapsed and reconstructed to improve the stackability and diminish the amount of space required to store the containers prior to use.

11 Claims, 4 Drawing Sheets

METHOD FOR FORMING AN INSULATING INNER CONTAINER

This application is a divisional of U.S. Ser. No. 08/681,996, filed on Jul. 30, 1996 now U.S. Pat. No. 5,820,268.

BACKGROUND OF THE INVENTION

The present invention relates to thermally insulating packaging. More particularly, the present invention relates to an improved method and apparatus for a packaging system with improved insulating, storage and cost effectiveness characteristics for transporting perishables and the like.

Over the last few years, the demand for edible perishables has dramatically increased. The well publicized health benefits of fresh edibles has fueled even greater growth in the demand for such products. Due to the nature of these fresh food products and the desire for off-season supply among consumers, it is frequently necessary to ship such products from remote locations to virtually every corner of the world.

The shipment or transport of perishable goods frequently requires that such materials remain at a stable temperature, which is either elevated or decreased with respect to ambient temperatures to which the packaging is exposed. Because of long transport times for perishable items and the sensitivity of certain of these items due to slight temperature fluctuations, considerable efforts have been made to provide shipping containers with improved insulating characteristics. Despite the at times satisfactory results of these prior art devices, they have likewise presented a number of drawbacks.

By far the most common material utilized in corrugated containers as an insulating packaging material has been expanded polystyrene (EPS) foam, which is commonly referred to as "STYROFOAM®". Although EPS has proven to possess acceptable insulating characteristics as a liner inside a corrugated box, for the shipment of perishable goods, use of this material has also required a number of compromises. To begin with, most packaging systems that use EPS liners have required a relatively thick liner of approximately 1 inch. Due to the thickness and density of the EPS materials they add weight to the packaging and increase freight costs while their cushioning effect in the overall packaging system is limited. The EPS liner therefore consumes a significant amount of space that could otherwise be utilized to ship a greater quantity of product.

Leakages from such a container is highly undesirable and can lead to degradation of the container material, weakening of its structural integrity and damage to the transporting aircraft or surface vehicle. Therefore, it is necessary that the EPS liner be formed in such a manner that the chances of such leakage occurring would be minimized. The joining of flat panels of polystyrene by gluing or other means has proven to be relatively ineffective and subject to separation upon jarring of the container. Molding of the EPS to a single piece liner again introduces additional cost, is not very flexible in terms of varying the size or thickness of the EPS liner. Such molding further requires substantial capital expenditure for each die mold needed to form EPS liners.

In addition, whether stored as flat panels or a molded container, the EPS liners require significant amounts of storage space. Since these liners are generally placed in corrugated type cartons, the user is left with a situation where the corrugated boxes are completely collapsible and can be stored flat and in large numbers without taking up much space, whereas the opposite is true for the EPS liners.

Due to the drawbacks presented by the EPS packaging system, substantial efforts have been directed to providing thermally insulated packaging without the use of an EPS liner. U.S. Pat. No. 4,889,252 to Rockom et al discloses the bonding of bubble-type insulation to an inner surface of a corrugated paper box. Because of the direct contact of the bubble-type insulation with the box, much of the potential thermal containment ability of the insulation is subject to being undermined by the conduction of temperatures through the insulation to or from the box and subsequently to or from the ambient atmosphere. Additionally, the box of Rockom is not fully collapsible once the insulation is bonded thereto. Many other recent efforts have been directed at attempting to substitute alternative packaging systems for the EPS liner.

While some of these systems provide arguably comparable insulating results, they frequently are cumbersome, costly, increase the weight of the overall package and decrease the volume of materials that can be transported in a given container. For example, U.S. Pat. No. 5,314,087 to Shea discloses a thermal reflective packaging system that requires at least one spacer inserted between an outer and inner container, as well as a spacer tray. Additionally, the pouch of Shea requires a layer of single or double-bubble radiant barrier material to be sealed within a vinyl pouch in an expensive and time consuming procedure.

A number of other known designs have attempted to utilize a bag constructed to nest inside a corresponding corrugated or other outer container. Such bag type constructions have generally not followed the contours of the outer container and have frequently had poor insulating characteristics. As a result, they have generally been either too large or too small for the usually rectangular container that they have been put inside of. As a result, they have often ended up bunched up at the bottom or area location with unwanted excess material at each end wasting productive packing space and adding packaging weight and thereby increasing shipping costs. Likewise, if the bags are significantly smaller than the outer container that they are in, significant packing space is again wasted.

Attempting to consistently vary the size of such bags to match their contents is again another costly and cumbersome experience. In addition, the performance of any insulating container degrades in direct proportion to how tight the container is sealed. Prior art bags have had problems particularly when a liquid was inside of the bag in providing an adequate moisture-proof seal and preventing spillage. Damage to the outer container and/or the material inside the bags frequently resulted. Furthermore, many prior art designs have been designed to perform optimally only when they are not fully loaded with perishable items.

It is therefore apparent that there exists a need in the art for an improved packaging method and apparatus for perishable materials that provides a highly insulative packaging structure that is light weight, less costly for storage and shipping purposes, easily conforms to the shape of an outer shipping container fully collapsible and has thermal characteristics at least as good as EPS in most applications.

SUMMARY OF THE INVENTION

With the foregoing in mind, it is an object of the present invention to provide a packaging system with improved insulating and thermal containment characteristics.

It is a further object of the present invention to provide a packaging which can be retrofitted to an existing transport container to improve the insulating characteristics thereof.

It is another object of the present invention to provide improved insulating packaging that can be constructed of a flat sheet of material to the exact specifications of the outer container that it will be used with in an easy, simple and cost-effective manner.

Yet another object of the present invention is to provide a simple and cost effective method for manufacturing such packaging systems.

It is a further object of the invention to provide effective insulating packaging means for preserving perishable goods which are easy to assemble, light weight, can be shipped and stored flat and unassembled.

It is still further object of the present invention to provide an insulating container that can be stored in finished condition, flat and can be easily and readily expanded to take the exact shape of the outer container that it is going to be used in conjunction with.

In order to implement these and other objects of the present invention, which will become more readily apparent as the description proceeds, a preferred embodiment of the present invention provides a method and apparatus for a fully collapsible inner container assembly, designed to be removably inserted into an outer container consisting essentially of a bottom, opposing first and second sidewalls and front and back walls, each constructed of a flexible insulating material having one metalized surface that closely follows the dimensions of the outer container, the first and second sidewalls and the front and back walls forming an integral moisture proof seal with the bottom and each other, an integral first foldable side extending above the first sidewall and having opposing edges, an integral foldable second side flap extending above the second sidewall and having opposing edges, an integral foldable front flap extending above the exit end, an integral folded back flap extending above the back end, a tape strip along one of the ends, and a top formed by folding the first and second side flaps toward each other and folding the front and back flaps toward each other until two of each of their edges become gusseted.

BRIEF DESCRIPTION OF THE DRAWINGS

The foregoing and other objects, features and advantages of the present invention will be apparent from the following description of preferred embodiments as illustrated in the accompanying drawings, wherein like reference numbers referred to the same parts throughout the various views.

DETAILED DESCRIPTION OF THE INVENTION

Figure 1:
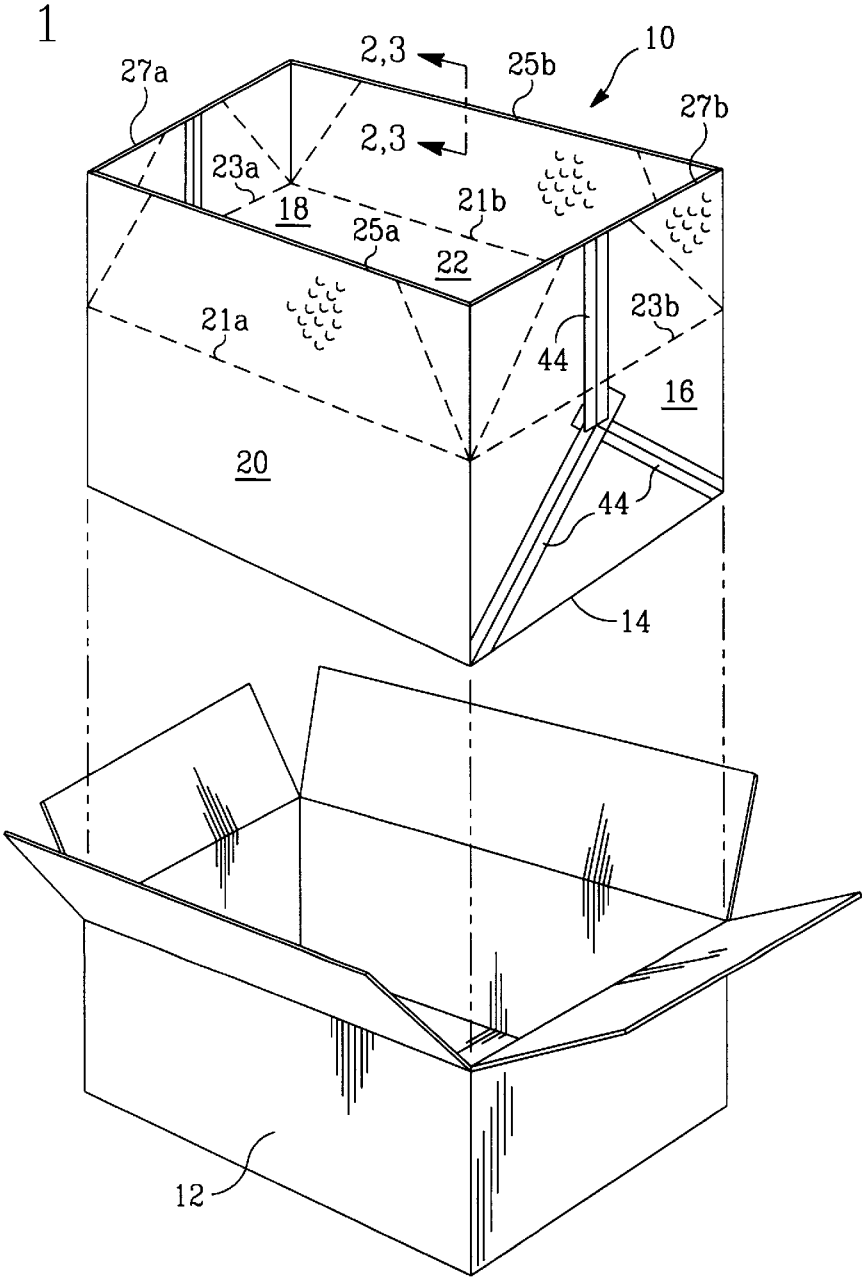
FIG. 1 is a schematic view of one embodiment of the present invention.
Figure 4:
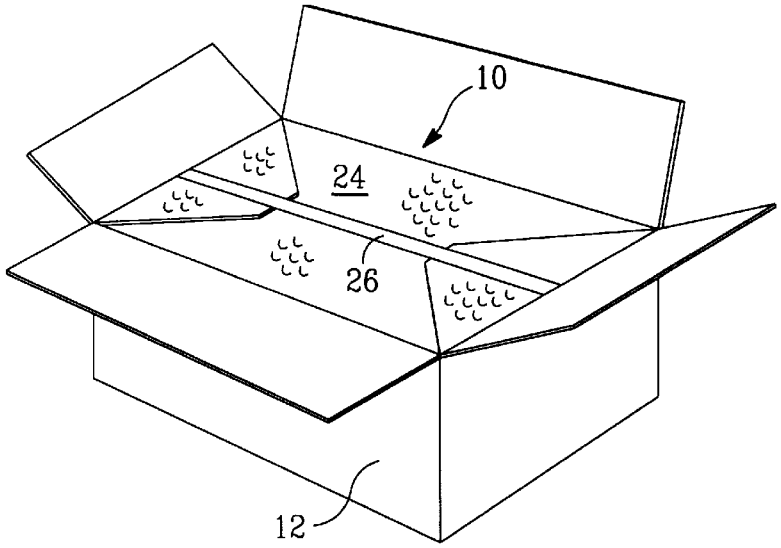
FIG. 4 is an assembled perspective view of FIG. 1.
Figure 10:
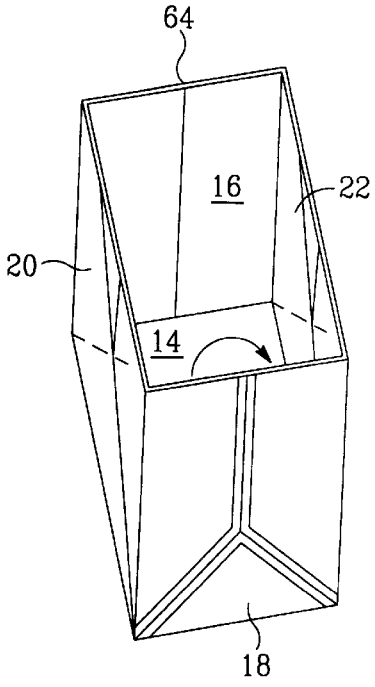
FIG. 10 is a perspective assembled view of the present invention.

Referring now to the drawings and in particular FIGS. 1, 4 and 10 the present invention provides an improved packaging transport system for perishables and the like. The invention provides a container 10 that is designed to be removably inserted and closely correspond to the dimensions of an outer container 12 such as a corrugated box. As will be described in more detail to follow, the inner container 10 is designed to be simply and easily constructed from a sheet of material. In its finished form the container 10 closely follows the shape and configuration of the outer container 12. Once constructed the container 10 can readily be collapsed into a space saving configuration for storage and then be subsequently reformed without necessitating further assembly when it is desired to be used.

As illustrated in FIGS. 1 and 10, the container 10 has a bottom 14 with oppositely disposed ends 16 and 18 and sides 20 and 22 all extending upwardly therefrom. The bottom 14 and ends 16 and 18 and sides 20 and 22 together form a gusseted pouch-like container 10 that will retain both liquid and moisture and prevent leakage therefrom.

The ends 16 and 18 and sides 20 and 22 respectively are designed to extend above the sidewalls and ends of the outer container 12 when the inner container is inserted therein. When the container 10 is used a top 24 is formed by folding the side flaps 25*a* and 25*b* inwardly along the fold lines 21*a* and 21*b* that are at approximately the same height as the sidewalls of the container 12. The end flaps 27*a* and 27*b* are then folded inwardly along the fold lines 23*a* and 23*b* over the side flaps 25*a* and 25*b*. Alternatively, the side flaps 25*a* and 25*b* could be folded over the end flaps 27*a* and 27*b* to form the top 24.

The top 24 is sealed by providing a self-sealing strip 26 along or connected to the top edges of one or more of the flaps 25*a*, 25*b*, 27*a* and 27*b* respectively to form a closed container 10 that fits entirely within an outer container that as illustrated in FIG. 4. Other alternative tape or sealing closures could be used in place of or in addition to the self-seal strip 26. The formation and closing of the top 24 results in a tight seal that significantly seals the contents of container 10 off from any air that might otherwise enter through the top of the container 12.

It has been found that the superior sealing of the container lo attained by use of the strip 26 has been quite important to the overall thermal effectiveness of the container. Since the inner container 10 is designed to be readily constructed to closely resemble the dimensions of the outer container 12, the container 10 maximizes the amount of useable packaging space for transporting perishable materials within the outer container 12. Additionally, the inner container 10 is designed so that it can be tightly wrapped around its contents whether completely full or not in order to minimize the air space within the container.

Figure 2:
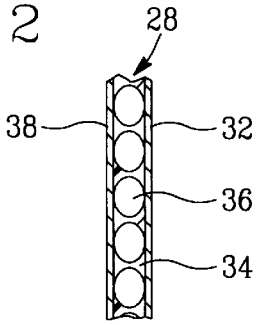
FIG. 2 is a cross-sectional view of material utilized by the present invention according to a first embodiment.
Figure 3:
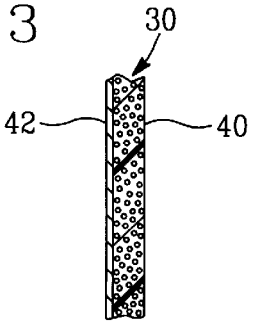
FIG. 3 is a cross-sectional view of material utilized by the present invention according to a second embodiment.

Referring to FIGS. 2 and 3, the inner container 10 is preferably constructed of a material having a metalized polyethylene or metallic foil laminated on one of its sides. One such material is commercially available from Astro-Valcour. FIG. 2 illustrates a first preferred material which is a foil laminated bubble pack generally referred to as 28. This material has a sidewall constructed of a thin foil laminate 32 such as metalized polyethylene. The foil laminate 32 is attached to a layer of polyethylene bubble packing material 36 that has a plastic or polyethylene side wall 38 opposite the foil laminate 32 and features a number of air pockets 34 within the material.

When formed into a container 10 having ½ inch thick walls the foil laminated bubble pack 28 has exhibited similar insulating characteristics to EPS foam containers having 1 inch thick walls. In addition, the cost of a foil laminated bubble pack container in accordance with the present invention is often about half of the cost of a similar size EPS container. The foil laminated bubble pack 28 can be used to form the container 10 with the laminate 32 forming either the inner or the outer sidewall of the container 10.

Most preferred results have been found when the foil laminate 32 is utilized as the inner sidewall of the container 10. A variety of different thicknesses of laminated bubble pack 28 may be used depending upon the requirements of the product to be shipped in the container 10. It has been found that a laminated bubble pack having a thickness of ½ inch to 3/16 inch has been particularly effective in certain circumstances.

Referring now to FIG. 3, an alternative insulating material for forming the inner container 10 is illustrated. This alternative material referred to generally as 30 consists of a thickness of polyethylene or polyurethane foam material 40 with a sheet of metalized polyethylene or metallic foil 42 laminated to one side of the foam material 40. The material 30 is preferably used with the metalized polyethylene 42 forming the inner wall of the container 10. Again, although a variety of thicknesses of polyethylene or polyurethane foam material 40 have been found effective and the given thickness will depend upon the desired properties for any particular shipment, beneficial results have been found with a foam material thickness of as little as ⅛ to ¼ inch.

As described above, the container 10 of the present invention is designed to be simply formed from a flat sheet of material such as laminated bubble pack 28 or laminated microfoam material 30. The formation of a container 10 will now be described in detail with particular reference to FIGS. 5–10.

Figure 5:
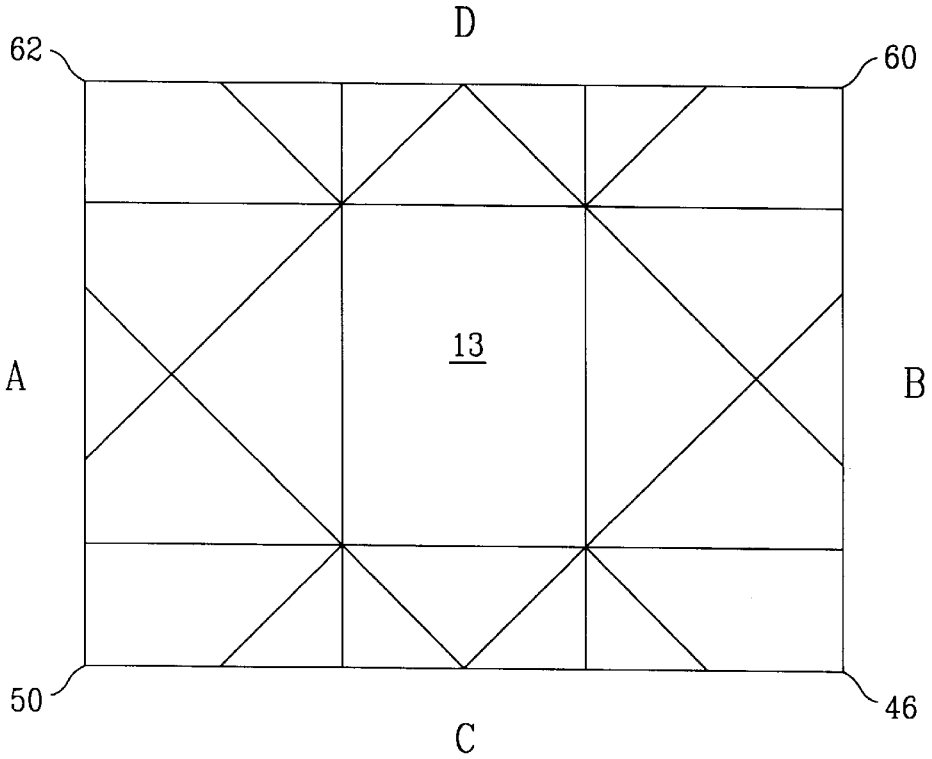
FIG. 5 is a schematic top view illustrating all the folds that are made in a flat sheet of material in order to form the present invention.

FIG. 5 illustrates all of the folds that are made to the sheet 13 in order to form the container 10. To begin with a sheet 13 of foil laminated bubble pack material 28 is cut from a continuous roll having dimensions that will form a container 10 of a desired size. In order to determine the proper size of the sheet the dimensions of the outer container 12 that the inner container 10 will be designed to fit in should be known. As can readily be appreciated, the dimensions of the sheet of material 28 can easily be varied and selected to match virtually any size outer container 12.

Figure 6:
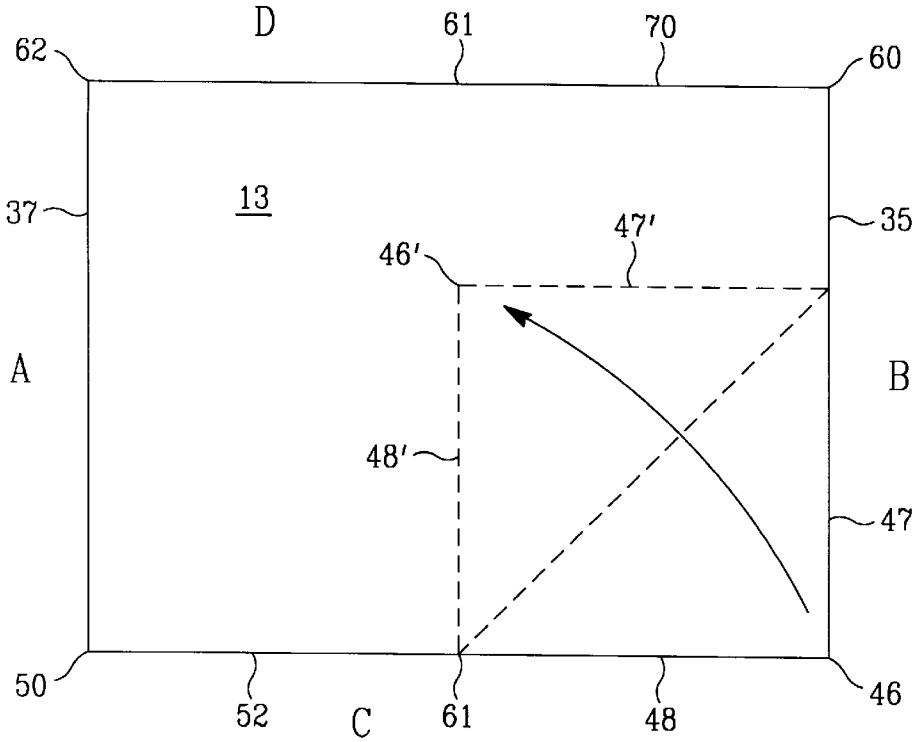
FIG. 6 is a top view of the first step required in forming the present invention out of a flat sheet of material.

Referring now to FIGS. 1, 5, 6 and 10, the sheet 13 of material 28 is cut to a dimension so that the distance between A and B as illustrated in FIG. 6 is equal to or slightly greater than the sum of twice the width of the bottom 14 and the height of the individual sides 20 and 22. The opposite dimension illustrated as dimension C-D in FIG. 6 is designed to be slightly longer than the length or opposite dimension of the bottom 14 of the container 10. In order to form the container 10, the corner 46 is folded over the remainder of the sheet 13 to a point 61 midway between the dimension A-B. In its folded position the corner 46, side edge 47 and end edge 48 occupy the new positions designated as 46', 47' and 48' respectively in dashed lines.

Figure 7:
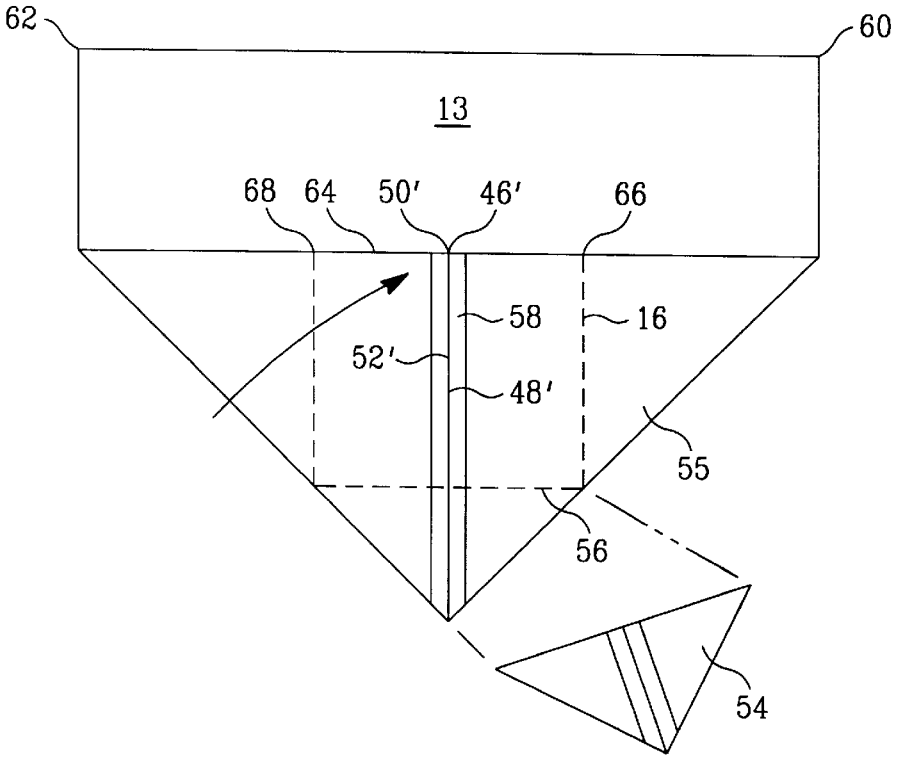
FIG. 7 illustrates the next step of forming the present invention out of a flat sheet of material.
Figure 8:
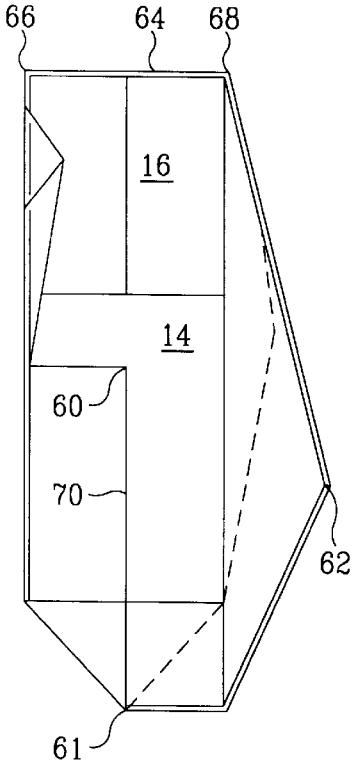
FIG. 8 illustrates the next step of forming the present invention out of a flat sheet of material.
Figure 9:
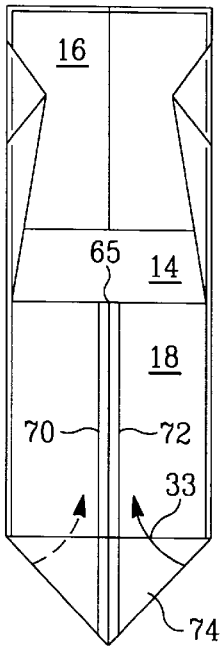
FIG. 9 illustrates the next step of forming the present invention out of a flat sheet of material.

As illustrated in FIG. 7, a similar fold to the one previously described is next done utilizing the opposite corner 50. The corner 50 is folded over the sheet 13 to a position indicated as 50' where it meets the opposite corner 46'. In this position the end edge 52 has moved to a position 52' butting against the end edge 48'. The end edges 48' and 52' are joined by taping or otherwise securing them together along their entire length. A variety of securing mechanisms can be used for this purpose. Two preferred commercially available mechanisms are two inch filament tape 44 manufactured by Anchor Tape, or use of filament or edge line heat sealer.

In the stage of construction illustrated in FIG. 7 a pouch 55 has been formed and one of the ends 16 of the container 10 is outlined in dashed lines. In addition, at this stage of construction a pocket 54 has been formed. That pocket 54 can either be severed and heat sealed along the line 56 using known means or can be folded up in the direction indicated by the arrow and taped, using tape 44, or otherwise adhered to the seal 58 that joins the end edges 48' and 52'.

Formation of the container 10 is continued as illustrated in FIG. 7 by raising the top edge 64 of the pouch 55 as indicated by the arrow in FIG. 1 until the end 16 is substantially perpendicular to the bottom 14. Next the opposite end 18 of the container 10 is formed by similarly folding the corner 60 inwardly over the bottom 14 of the sheet 13 until it reaches the mid-point 61 of the dimension D. The opposite corner 62 is then folded so that the end edge 72 meets the edge 70 along the line 61. The edges 70 and 72 are then joined by taping or other suitable sealing means across their entire lengths.

Figure 11:
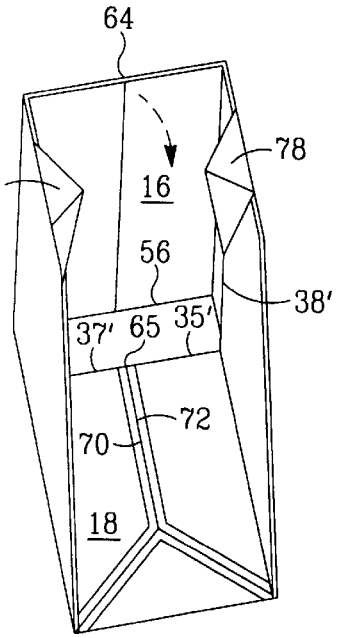
FIG. 11 is a perspective view of the first step in collapsing the present invention for storage.

A second pocket 74 is likewise formed by the joining of the end edges 70 and 72. As previously described, the pocket 74 can either be cut and heat sealed or folded upwardly along the line 33 as indicated by the arrows in FIG. 8 and subsequently taped or otherwise sealed to the outside of the end 18. As illustrated in FIG. 11, when the end edges 70 and 72 are joined and the end 18 is resting against the bottom 14 a portion of the side edges 35 and 37 form a top of the end 18 against the bottom 14. The remainder of the end edges 35' and 37' extend upwardly in a substantially perpendicular manner from the bottom 14 and the end 18 in this configuration.

In order to finish formation of the container 10 the top 65 of the end 18 is raised from the bottom 14 until the end 18 extends upwardly substantially perpendicular from the bottom 14 as illustrated in FIG. 10. When in the configuration in FIG. 9 the finished container 10 can be inserted into an outer container 12 as illustrated in FIGS. 1 and 4 and filled and sealed for shipment as previously described.

In the alternative, once the container 10 has been fully constructed, it can readily be collapsed into a flat configuration and stored in a manner that occupies a minimum of space. Once it is desired to use the container 10 it can be easily reassembled to the configuration illustrated in FIG. 10 in a matter of seconds. The process of collapsing the constructed container 10 for storage will now be described in detail with reference to FIGS. 11–13.

Figure 12:
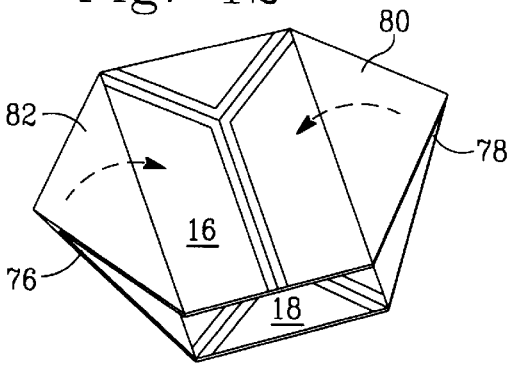
FIG. 12 is a perspective view of the next step in collapsing the present invention for storage.
Figure 13:
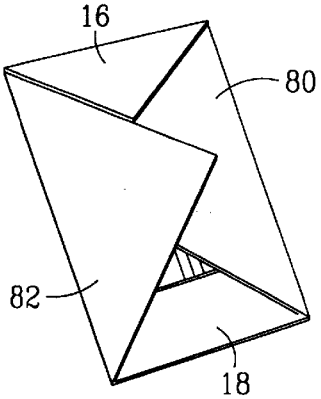
FIG. 13 is a perspective view of an embodiment of the present invention in a flat collapsed form for storage.

Referring now to FIG. 11, in order to collapse the container 10 for storage the top 65 of the end 18 is folded downwardly along the line 33 until it meets the bottom 14 of the container 10. This causes the sides 20 and 22 respectively to partially fold inwardly. The top 64 of the opposite end 16 is then likewise folded downwardly as indicated by the arrow on top of the bottom 14 along the line 56. When the side 16 is folded completely down it likewise overlaps a substantial portion of the side 18 as indicated in FIG. 12.

The action of folding the end 16 down on top of the opposite end 18 completes the formation of folds 76 and 78 that collapse the sides 20 and 22 respectively and form flaps 80 and 82. The flaps 80 and 82 are then folded one over another as indicated by the arrows in FIG. 12 to form the final storage configuration of the container 10 illustrated in FIG. 13.

In this configuration, the footprint of the container 10 is the same size as the bottom thereof 14. The collapsed container 10 can then be readily stacked in this manner and requires a space that is only several times the thickness of the foil laminated bubble pack 28 to be stored in a flat space-saving condition. The container 10 then can readily be reformed by performing the steps indicated to collapse the container in reverse order as they were described in connection with FIGS. 10–13. The compact storage and ease of collapsing and reconstructing the formed container 10 provides substantial advantages over existing EPS containers.

The following examples are given to aid in understanding the invention and it is to be understood that the invention is not limited to the particular procedures or the details given in these examples.

EXAMPLE I

A set of tests were performed in order to attempt to analyze the performance of the present invention compared to other assorted inner insulating containers under various conditions for a fresh food product. The test was designed to measure the insulating ability of containers not refrigerated prior to packing that contained fresh fish and were exposed to a harsh (95° F.) environment.

In order to insure accurate results, a number of parameters were held constant for all of the inner insulated containers tested. To begin with, the inner insulating containers were all placed within a regular slotted single wall "C" flute corrugated shipping container with a mottled white liner. The empty insulating containers were all conditioned together in the same container at 95° F. and greater than or equal to 75% relative humidity for more than 24 hours prior to testing.

The corrugated containers were sized to maintain an internal volume of approximately 1 cubic foot and were each lined with a 0.003" gauge polyethylene bag. Fresh fish was provided and conditioned together to the same state specifically 36° F. and approximately 70% relative humidity for more than 24 hours prior to packing. At that time, 2–3 fish (or approximately 10 pounds) were placed in the bottom of each insulating container and two thermocouples were inserted into and/or placed onto the fish for test cycle monitoring.

Two pound gel packs were provided and conditioned to 0° F. for more than 24 hours prior to testing. Two gel packs or four pounds total were placed on top of the fish packed within each insulated container. The gel packs were received frozen but in non-uniform pillow shapes. The units were therefor thawed and then refrozen in a flat orientation to achieve a uniform configuration prior to testing.

All insulating containers constructed in accordance with the present invention were double sealed with a self sealing tear strip as well as an additional strip of 2 inch filament tape, except carton number 6 as noted below. The EPS sheet boxes and chests were not sealed. After packing under ambient conditions nominally 68° F., 50% relative humidity. The seven fresh product containers were placed into a chamber maintained at approximately 90–95° F. and 75% relative humidity at the same time.

The test chamber was maintained at a uniform state by means of convection, however, the air was constantly submitted to mixing fan systems running at all times. The recorder monitored the temperature every 30 minutes. for the test duration. The insulated containers were retained in the test chamber until all of them reached an internal temperature over 65° F. defined as maximum break through time.

The empty insulated packing system numbers 1–7 were conditioned together in the same chamber and to the identical states, specifically 95° F. and greater than or equal to 75% relative humidity for more than 24 hours prior to testing. The following insulating inner containers were tested:

| Carton (#) | Insulating Inner Container | Style |
|---|---|---|
| 1 | Present invention-a gusseted bag constructed of a ½ inch thick bubble pack with a sheet of metalized polyethylene laminated on the inside of the bag. | Flexible bag |
| 2 | Six (6) sheets of 1.0 pound per cubic foot density of expanded polystyrene foam ½ inch thick custom cut to line the top, bottom, sides and ends of the corrugated container. | Rigid EPS box from sheets |
| 3 | Six (6) sheets of 1.0 pound per cubic foot density of expanded polystyrene foam 1 inch thick custom cut to line the top, bottom, sides and ends of the corrugated container. | Rigid EPS box From sheets |
| 4 | A two piece container molded from EPS foam, 1.25 pound per cubic foot density with 1 inch thick walls. | Molded Rigid EPS Chest |
| 5 | Present invention-a gusseted bag constructed of a ½ inch thick bubble pack with a sheet of metalized polyethylene laminated on the inside of the bag. | Flexible Bag |
| 6 | Present invention-a gusseted bag constructed of a ½ inch thick bubble pack with a sheet of metalized polyethylene laminated on the inside of the bag sealed with tear strip only. | Flexible Bag |
| 7 | Gusseted bubble pack bag ½ inch thick without metalized polyethylene lamination. | Flexible bag |

The following results were observed

| Rank | Carton (#) | Insulating System/Thickness | Max Time |
|---|---|---|---|
| 1 | 6 | Present invention, no tape -- ½" | 19.0 |
| 2 | 3 | 6 sheets 1#/ft$^3$ EPS -- 1" | 17.5 |
| 3 | 5 | Present invention -- ½" | 17.0 |
| 4 | 4 | Molded 1.25#/ft$^3$ EPS -- 1" | 14.5 |
| 5 | 1 | Present invention -- ½" | 14.5 |
| 6 | 2 | 6 sheets 1#/ft$^3$ EPS -- ½" | 14.0 |
| 7 | 7 | No metalized laminate -- ½" | 8.0 |

As can be seen from the above test results, the ½ inch thick metalized bubble container constructed in accordance with the present invention performed better than the ½ inch EPS insulation system. The ½ inch metalized bubble container constructed in accordance with the present invention performed comparably to both 1 inch EPS insulation systems (sheet and chest). The non-metalized bubble bag insulated container of carton #7 performed significantly worse than the metalized systems constructed in accordance with the present invention.

EXAMPLE II

Another test was conducted to compare the performance of various insulating inner containers where the containers were refrigerated prior to packaging to approximate a cold packing situation. The parameters for this test were the same as those described in Example I above, except as indicated below. In this test the cartons and their inner containers were conditioned together in the same chamber at 36° F. and 70% relative humidity for more than 24 hours prior to testing. The following insulating inner containers were tested:

| Carton (#) | Insulating Inner Container | Style |
|---|---|---|
| 8 | Present invention- a gusseted bag constructed of a ½ inch thick bubble pack with a sheet of metalized polyethylene laminated on the inside of the bag. | Flexible bag |
| 9 | Six (6) sheets of 1.0 pound per cubic foot density of expanded polystyrene foam, 1 inch thick custom cut to line the top, bottom, sides and ends of the corrugated container. | Rigid EPS box from sheets |
| 10 | A two piece container molded from EPS foam, w.25 pound per cubic foot density with 1 inch thick walls. | Rigid EPS box From sheets |

The containers were again tested to determine the time required to achieve a maximum break through temperature of 65° F. within the inner container. The results were as follows:

| Rank | Carton (#) | Insulating System/Thickness | Max Time |
|---|---|---|---|
| 1 | 10 | Molded 1.25#/ft$^3$ EPS -- 1" | 18.5 |
| 2 | 9 | 6 sheets 1#/ft$^3$ EPS -- 1" | 17.5 |
| 2 | 8 | Present invention -- ½" | 17.5 |

The test results set forth above indicate that the inner container constructed in accordance with the present invention having a ½ inch thick metalized bubble material performed comparably to the containers with the 1 inch EPS insulation systems (both sheet and chest). The conclusions for the samples submitted to the high temperature preconditioning in Example I were about the same for the samples submitted to the low temperature preconditioning in Example II, with the low temperature preconditioning affording an average performance improvement of 1 to 3.5 hours of additional break through time. From these examples it is clear that the present invention was demonstrated to produce very effective desired results.

We claim:

1. A method of forming an insulating inner container having opposing side ends and a bottom from a flat sheet of flexible material having a metalized surface to be inserted into and closely follow the dimensions of a selected outer container having opposing side ends and a bottom from a flat sheet of flexible material having a metalized surface, comprising the steps of:

cutting the sheet of flexible material of the inner container to a rectangular configuration having first, second, third and fourth corners so that:

a first dimension of the sheet is equal to or greater than the sum of twice the width of the bottom of the inner container and the height of each of the opposing sides of said inner container, and a second opposite dimension of the sheet taken perpendicular to the first dimension of the sheet, is greater than the length of the bottom of said inner container;

folding said first corner inwardly over the remainder of the sheet to the mid-point of said first dimension of said sheet to form a first flap;

folding said second corner inwardly over said sheet so that it meets said first corner at said mid-point of said first dimension to form a second flap that partially abuts said first flap;

sealing said first flap to said second flap along the area where they abut to form a first gusseted pouch;

manipulating an end of the first gusseted pouch to define a linear edge between a first of the side ends of the inner container and the bottom of the inner container;

raising said first gusseted pouch at its center above said sheet until it is substantially perpendicular to said sheet and a portion of said first gusseted pouch forms said first of the side ends of said inner container;

folding said third corner inwardly over the sheet to said mid-point of said first dimension of said sheet to form a third flap;

folding said fourth corner inwardly over the sheet so that it meets said third corner at said mid-point of said first dimension to form a fourth flap that partially abuts said third flap;

sealing said third flap to said fourth flap where they abut to form a second gusseted pouch; and manipulating an end of the second gusseted pouch to define another linear edge between a second of the side ends of the inner container and the bottom of the inner container;

raising said second gusseted pouch at its center until it is substantially perpendicular to said sheet and a portion of said second gusseted pouch forms said second of the side ends of said inner container and the remainder of said second gusseted pouch forms a portion of opposing sides of said inner container, said opposing sides being substantially perpendicular to said side ends.

2. The method of claim 1 further comprising:

folding a portion of each of said opposing sides inwardly until they abut each other; and folding said side ends inwardly in order to form a top of said inner container.

3. The method of claim 2 further comprising the step of sealing the top of the inner container.

4. The method of claim 1 wherein said folding steps are all performed so that the metalized surface of the flexible material is along the inner surface of the inner container.

5. The method of claim 1 further comprising the step of inserting the formed inner container into said outer container.

6. The method of claim 1, wherein said step of manipulating an end of the first gusseted pouch is performed by folding the end of the first gusseted pouch up and over to overlap the first gusseted pouch.

7. The method of claim 1, wherein said step of manipulating an end of the second gusseted pouch is performed by folding the end of the second gusseted pouch up and over to overlap the second gusseted pouch.

8. The method of claim 1, wherein said step of manipulating an end of the first gusseted pouch is performed by cutting off the end of the first gusseted pouch.

9. The method of claim 1, wherein said step of manipulating an end of the second gusseted pouch is performed by cutting off the end of the second gusseted pouch.

10. The method of claim 1, wherein said step of manipulating an end of the first gusseted pouch is performed by heat sealing along said linear edge.

11. The method of claim 1, wherein said step of manipulating an end of the second gusseted pouch is performed by heat sealing along said another linear edge.

* * * * *